US007490815B2

(12) United States Patent
Tolléns et al.

(10) Patent No.: US 7,490,815 B2
(45) Date of Patent: Feb. 17, 2009

(54) DELIVERY SYSTEM FOR DISPENSING VOLATILE MATERIALS USING AN ELECTROMECHANICAL TRANSDUCER IN COMBINATION WITH AN AIR DISTURBANCE GENERATOR

(75) Inventors: Fernando Ray Tolléns, Cincinnati, OH (US); Christopher Robert Kopulos, West Chester, OH (US); Jonathan Robert Cetti, Mason, OH (US); Steven James Schroeck, Cincinnati, OH (US); Steven Louis Diersing, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 385 days.

(21) Appl. No.: 11/273,461

(22) Filed: Nov. 14, 2005

(65) Prior Publication Data

US 2007/0108310 A1 May 17, 2007

(51) Int. Cl.
*B01F 3/04* (2006.01)

(52) U.S. Cl. ..... 261/30; 261/81; 261/DIG. 48; 261/DIG. 88

(58) Field of Classification Search ..... 261/28, 261/30, 37, 81, DIG. 48, DIG. 88
See application file for complete search history.

(56) References Cited

U.S. PATENT DOCUMENTS

| | | | | |
|---|---|---|---|---|
| 3,543,122 | A | 11/1970 | Klebanoff et al. | |
| 3,615,041 | A | 10/1971 | Bischoff | |
| 4,479,609 | A | 10/1984 | Maeda | |
| 4,533,082 | A | 8/1985 | Maehara et al. | |
| 4,731,204 | A * | 3/1988 | Noma et al. | 261/30 |
| 4,790,479 | A | 12/1988 | Matsumoto | |
| 5,152,456 | A * | 10/1992 | Ross et al. | 239/102.2 |
| 5,297,734 | A | 3/1994 | Toda | |
| 5,485,828 | A * | 1/1996 | Hauser | 128/200.16 |
| 5,518,179 | A | 5/1996 | Humberstone et al. | |
| 5,624,608 | A * | 4/1997 | Ching et al. | 261/30 |
| 5,836,515 | A * | 11/1998 | Fonzes et al. | 239/102.2 |
| 6,039,309 | A * | 3/2000 | Kuklinski | 261/1 |
| 6,062,212 | A * | 5/2000 | Davison et al. | 128/200.16 |
| 6,102,992 | A * | 8/2000 | Berg et al. | 96/361 |
| 6,341,732 | B1 | 1/2002 | Martin et al. | |

(Continued)

FOREIGN PATENT DOCUMENTS

WO WO 03/068413 A1 8/2003

(Continued)

OTHER PUBLICATIONS

International Search Report received in connection with PCT/IB2006/054243, mailed on Apr. 5, 2007, 4 pages.

*Primary Examiner*—Scott Bushey
(74) *Attorney, Agent, or Firm*—Amy I. Ahn-Roll

(57) ABSTRACT

Disclosed herein is a delivery system or apparatus for the production, evaporation or release and wide dispersion of volatile materials using an electromechanical transducer or electromechanical transducer, wherein the transition from droplets to the molecular level of the volatile material is assisted by an air disturbance generator. By increasing the rate of droplet disintegration and the emission or release of the volatile materials, higher detection of the less volatile components is achieved, resulting in higher volatile material concentration and improved hedonics, thus delivering an improved method of dispensing such volatile materials. The system is highly energy efficient and capable of battery operation.

11 Claims, 1 Drawing Sheet

U.S. PATENT DOCUMENTS

| | | | | |
|---|---|---|---|---|
| 6,361,024 | B1 * | 3/2002 | Carson | 261/30 |
| 6,378,780 | B1 | 4/2002 | Martens, III et al. | |
| 6,390,453 | B1 | 5/2002 | Frederickson et al. | |
| 6,712,287 | B1 | 3/2004 | Le Pesant et al. | |
| 2004/0021006 | A1 * | 2/2004 | Mounteney | 239/398 |
| 2004/0261790 | A1 * | 12/2004 | Joshi et al. | 128/200.16 |
| 2005/0212152 | A1 * | 9/2005 | Reens | 261/81 |
| 2005/0223890 | A1 * | 10/2005 | Matsuura | 95/29 |
| 2005/0279854 | A1 * | 12/2005 | Martens et al. | 239/44 |
| 2006/0011739 | A1 * | 1/2006 | Jaworski | 239/102.2 |
| 2006/0188238 | A1 * | 8/2006 | Kent | 392/394 |

FOREIGN PATENT DOCUMENTS

| | | | |
|---|---|---|---|
| WO | WO 2006/009743 | A1 | 1/2006 |
| WO | WO 2006/096303 | A2 | 9/2006 |

* cited by examiner

DELIVERY SYSTEM FOR DISPENSING VOLATILE MATERIALS USING AN ELECTROMECHANICAL TRANSDUCER IN COMBINATION WITH AN AIR DISTURBANCE GENERATOR

FIELD OF THE INVENTION

The present invention relates to delivery systems for emitting droplets of liquid active materials, such as a perfume, air freshener, insecticide formulation, and volatile materials, as in a fine spray, to the atmosphere by means of a piezoelectric device, wherein the transition from droplets to molecular level of the volatile material is assisted by an air disturbance generator In particular, the invention is directed to a piezoelectric liquid delivery system for production of droplets of liquid or liquid suspensions, by means of an electromechanical or electroacoustical transducer assisted by an air disturbance generator. The air disturbance generator is used to accelerate the transition of droplets to finer droplets or to a molecular level or state as a means to increase active material diffusion. By accelerating the transition of the droplets to the molecular level and thus the diffusion of the active ingredient, an improved method of dispensing such liquids is achieved.

BACKGROUND OF THE INVENTION

This invention relates to delivery systems or apparatus for the production and distribution of liquids droplets by means of an electromechanical transducer. A number of processes exist for the generation of droplets using electromechanical actuation. One method for such distribution is to atomize a liquid by a device comprising a membrane which is vibrated by an electromechanical transducer which has a composite thin-walled structure, and is arranged to operate in a bending mode. Liquid is supplied directly to a surface of the membrane and sprayed therefrom in fine droplets upon vibration of the membrane. An example of such a method is shown by Humberstone et al, in U.S. Pat. No. 5,518,179.

Another atomizer spraying device is described by Toda, U.S. Pat. No. 5,297,734. This application teaches the use of ultrasonic atomizing devices comprising piezoelectric vibrators with a vibrating plate connected thereto. The vibrating plate is described as having a large number of small holes therein for passage of the liquid.

Another electromechanical atomizer spraying device is shown by Martin et al, in U.S. Pat. No. 6,341,732, this device allows fluid to be withdrawn from a reservoir to be atomized effectively and continuously without liquid build-up on the atomizing element by allowing the fluid to flow back to the reservoir without spilling or waste.

In yet another electromechanical atomization system, Martens III et al, U.S. Pat. No. 6,378,780, described a battery operated device that can be used to automatically dispense liquids to any given environment, over an extended period of time, with the advantage of uniformly dispensing equal amounts of liquid to the atmosphere over the life span of the battery. The accuracy in dispensing rate is claimed to translate into consistency with respect to perfume character and intensity. In addition, the amount of liquid being dispersed may be varied to adjust intensity for personal preference, efficacy, or for room size. This system also claimed that the life of the power source is lengthened by control of the viscosity and surface tension of the liquid to be dispensed to within specified ranges.

U.S. Pat. No. 6,712,287, assigned to Osmooze, relates to a piezoelectric element fastened to a delivery needle to generate droplets that are then diffusion assisted by a mechanical device or air pump to reduce habituation. However, the use of a needle as droplet generation element is limited when compare with a perforated plate, because the needle does not provide any physical element to control droplet particle size. In this application, the droplet size is determined by the surface tension and viscosity of the formulation, significantly reducing the performance and fields of application of the design. Droplets generated in this manner are typically in the range of 20 to 50 microns, too large to be supported or carried by typical air currents and not suited for air freshener applications even with the use of assisted air flow devices. In addition, droplets of the size generated by this device will require higher air flow volumes to stay airborne. Attempts to decrease the diameter of the needle significantly increase the work load on the piezoelectric element and thus power consumption.

While there are a significant number patents that disclose means for the dispersion of liquids by ultrasonic atomization using given time intervals, or viscosity or surface tension ranges, they have achieved only moderate success in the efficient atomization and dispersion of the liquid droplets to deliver acceptable room fill with a balanced composition. This is of greater importance with complex materials such as perfume formulations. See, for example, U.S. Pat. Nos. 3,543,122, 3,615,041, 4,479,609, 4,533,082, and 4,790,479. The disclosures of these patents, and of all other publications referred to herein, are incorporated by reference as if fully set forth herein.

These atomizer systems fail to provide an electromechanical atomization system capable of delivering complex perfume formulations for extended periods of use that provide consistency with respect to intended character, intensity and emission rate. Further, these systems fail to deliver wide dispersal of the fluid in an energy efficient manner, resulting in a device that does not deliver acceptable and user-preferred room fill. It is even more challenging to deliver such a benefit in an easily portable and compact battery operated dispenser. Thus, a need exists for improved atomizers or dispensers for use in the delivery and distribution of active fluids such as fragrances and other volatile ingredients, in a highly efficient manner consuming minimal electrical power while providing wide dispersal of the liquid.

SUMMARY OF THE INVENTION

Figure 1:
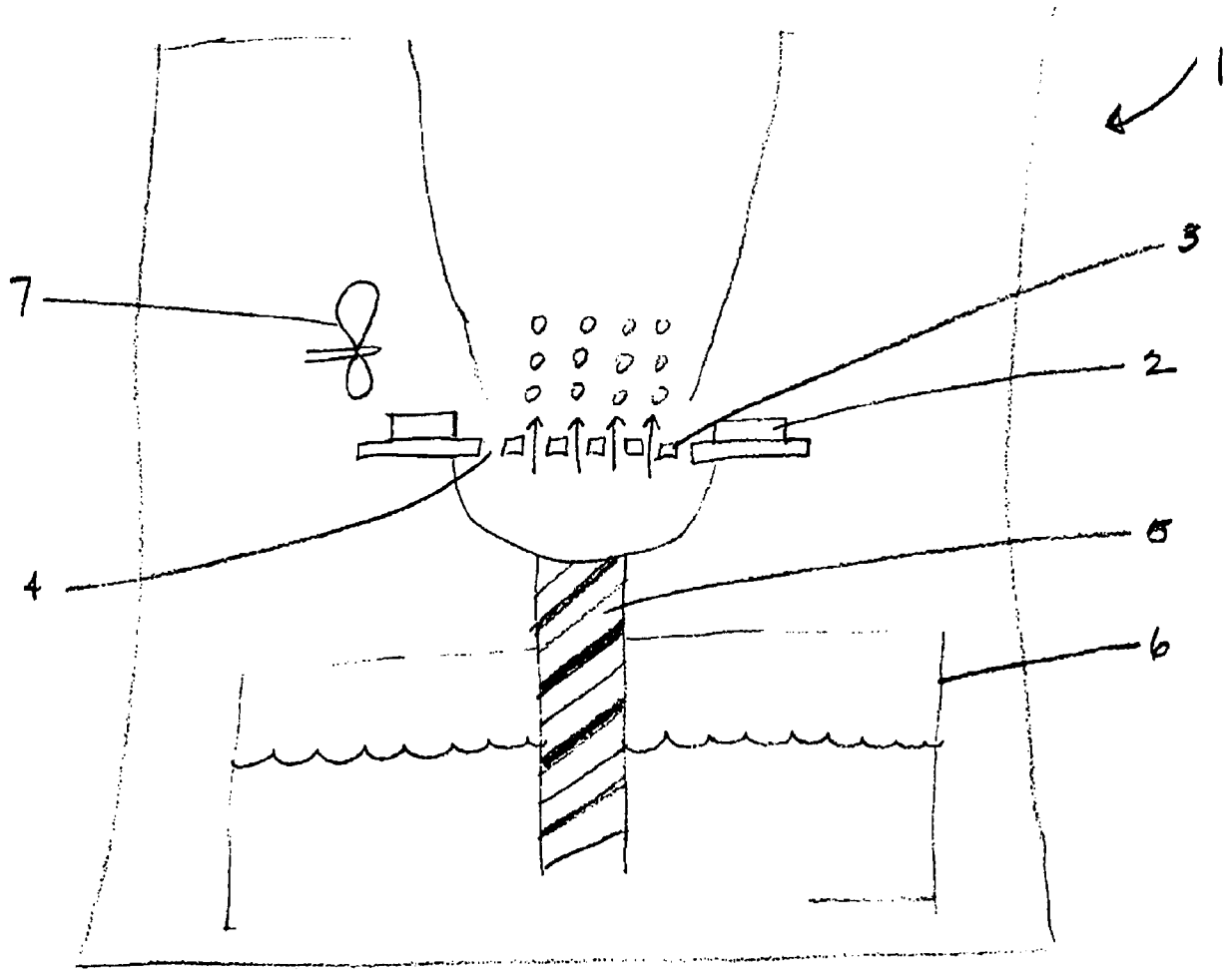
FIG. 1 is a cross-sectional view of one embodiment of the present invention.
Figure 1:
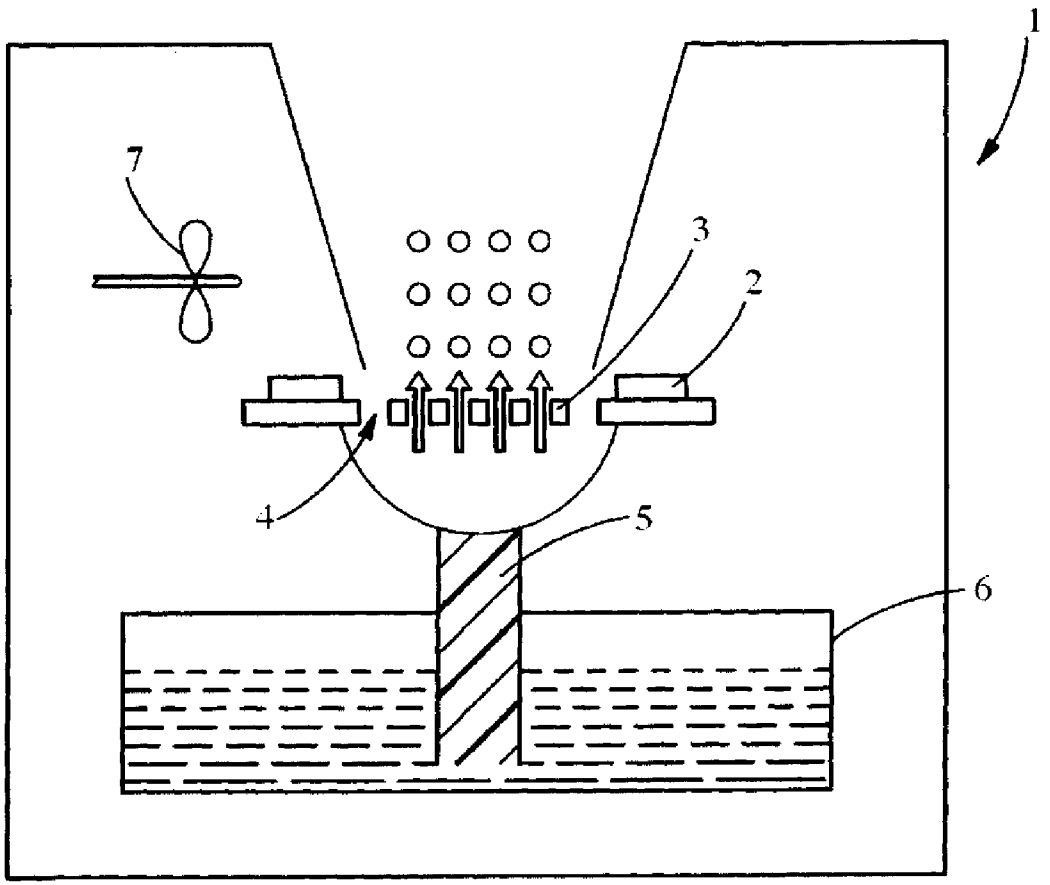

In one embodiment of the present invention, a highly efficient delivery system or apparatus is provided for the production and wide dispersion of liquid droplets of perfumes and other volatile materials in an energy efficient manner. Such materials include solid dispersions and emulsions and any other heterogeneous formulations that may benefit from a particle atomization process. These compositions may be aqueous, or comprise various solvents.

In another embodiment of the present invention, a device for generating droplets or an atomization system is provided comprising a fluid reservoir or chamber from which the liquid is to be dispensed, a fluid supply component, an electromechanical transducer, wherein the expansion or contraction of the electromechanical transducer takes place in a dimension perpendicular to the applied electric field; and a droplet generation element coupled for movement with the expansion/ contraction of the electromechanical transducer in the direction of the given dimension and positioned for contact with fluid from the fluid supply component, wherein the droplet generation element has two or more orifices; an air disturbance generator; an energy source and circuitry to drive and control the electromechanical transducer and air disturbance generator.

In another embodiment of the present invention, the apparatus comprises a fluid supply component, a fluid reservoir or chamber from which the liquid is to be dispensed, an electromechanical transducer having electrodes arranged so as to cause expansion or contraction of the electromechanical transducer in a dimension perpendicular to the applied electric field; and a perforated plate coupled for movement with the expansion/contraction of the electromechanical transducer in the direction of the given dimension and positioned for contact with fluid from the fluid supply component, an air disturbance generator to accelerate the droplet transition to molecular level, an energy source that provides the electrical power to energize the system, and a circuitry to drive and control the electromechanical transducer and air disturbance generator.

In one type of device, the transducer may be tubular and is expandable or contractible in the direction of its central axis. This (and other constructions in accordance with the present invention) enables a uniform electric field to be provided in the radial direction so as to provide a strain that is largely independent of thickness. Thus the electromechanical transducer is caused to operate in an extensional mode. Alternatively, the transducer may be disc-shaped or annular and is expandable or contractible in the radial direction.

The liquid reservoir, which contains a liquid to be atomized, is mounted below the electromechanical transducer and orifice plate and it is preferably made of plastic or glass. The fluid supply component connects the liquid reservouir to the movable element. The movable element is preferably connected with the fluid supply component and/or reservoir to form a replaceable sub-assembly or fluid cartridge assembly.

A suitable power source for the electromechanical transducer includes whatever means are needed, e.g. electronics and electrical circuitry, to produce the desired electrical drive for the electromechanical transducer. Examples of suitable power sources include a battery, an electrical outlet and a solar cell.

A manually operated switch can be provided for actuating the electronics. The switch may be mechanical or electronic. Such an electronic switch may be actuated by a timer or by a sensor or by other means.

The devices of the invention may have the transducer electrodes disposed across those two surfaces which give the shortest inter-electrode distance, and the transducer may have a dimension which is much greater than that inter-electrode distance, so that it is the extension of that large dimension of the electromechanical transducer that is used to excite the perforated membrane.

The air disturbance generator can be a fan, an air pump, a secondary electromechanical transducer or a combination thereof. It is used to increase fluid droplet instability in such a way as to accelerate the transition of fluid droplets to finer droplets and to the gas phase or molecular level of the volatile materials, increasing the ability of the volatile material to remain airborne. In one embodiment, the faster acceleration is achieved when the air flow volume is in the range between about 2.0 to about 8.0 cubic feet per minute (CFM). In another embodiment the air flow volume is about 3.0 CFM.

In one embodiment, the device of the current invention is refillable. In another embodiment, the device of the present invention comprises one or more fluid supply components, multiple fluid reservoirs, multiple electromechanical transducers, multiple droplet generation elements coupled for movement with one or more of the electromechanical transducers and positioned for contact with said fluid, and a fan. The droplet generation element has one or more orifices and said multiple fluid reservoirs contain scent emitting volatile materials.

In one embodiment, the scent delivery system apparatus is preferably compact and of relatively small overall diameter. In another embodiment, the apparatus generates a well defined droplet pattern that is easily volatilizable with relatively high electrical efficiency and is capable of operating from an internal power source. For example, the apparatus can be battery operated.

In another embodiment, a scent delivery system is provided that is capable of operating efficiently for months, on low voltage batteries, while maintaining scent delivery consistency throughout the usage period. i.e., the same character and intensity on the last day as it was perceived on the first day of usage.

In another embodiment, an apparatus is provided that may be driven from a compact electrical circuit and power source.

In another embodiment, an apparatus is provided that generates a well defined droplet pattern that is easily volatilizable and is plugged directly into the wall outlet.

In another embodiment, a piezoelectric apparatus is provided wherein the fluid supply component is delivered by a process selected from the group consisting of: gravity feed, wicking, capillary action, pumping action and combinations thereof.

In another embodiment, a piezoelectric apparatus is provided having multiple electromechanical transducers to provide the benefit of delivering multiple volatile material compositions while the apparatus can be battery operated or plugged directly into the wall outlet.

DETAILED DESCRIPTION OF THE INVENTION

This invention relates to delivery systems or apparatus for emitting droplets of liquid active materials made of materials such as perfumes, air fresheners, or other volatile liquids or volatile materials in which the transition or evaporation of the droplets to the molecular level of the volatile material is accelerated by the addition of air flow disturbance. Several non-limiting embodiments are described herein, as are several components of the system, each of which may constitute an invention in its own right or together with other components.

The volatile materials can be emitted in various facilities, which include but are not limited to rooms, houses, hospitals, offices, theaters, buildings, and the like, or into various vehicles such as trains, subways, automobiles, airplanes and the like.

The term "volatile materials" as used herein, refers to a material that is vaporizable. The terms "volatile materials", "aroma", and "scents", as used herein, include, but are not limited to pleasant or savory smells, and, thus, also encompass scents that function as insecticides, air fresheners, deodorants, aromacology, aromatherapy, or any other odor that acts to condition, modify, or otherwise charge the atmosphere or to modify the environment.

In addition, the term "volatile materials" as used herein, refers to a material or a discrete unit comprised of one or more materials that is vaporizable, or comprises a material that is vaporizable without the need of an energy source. Any suitable volatile material in any amount or form may be used. The term "volatile materials", thus, includes (but is not limited to) compositions that are comprised entirely of a single volatile material. It should be understood that the term "volatile material" also refers to compositions that have more than one volatile component, and it is not necessary for all of the component materials of the volatile material to be volatile. The volatile materials described herein may, thus, also have non-volatile components. It should also be understood that when the droplets of liquid active materials are described herein as being "emitted" or "released," this refers to the volatilization of the evaporative components of the volatile materials and to the release to the environment of the non-evaporative components, which may be small solids or particulates. The volatile materials of interest herein can be in any suitable form including, but not limited to: dispersion of solids, emulsions, liquids, and combinations thereof. For example, the delivery system may contain a volatile material comprising a single-phase composition, multi-phase composition and combinations thereof, from one or more sources in one or more carrier materials (e.g. water, solvent, etc.).

The terms "volatile materials", "aroma", and "emissions", as used herein, include, but are not limited to pleasant or savory smells, and, thus, also encompass materials that function as fragrances, air fresheners, deodorizers, odor eliminators, malodor counteractants, insecticides, insect repellants, medicinal substances, disinfectants, sanitizers, mood enhancers, and aroma therapy aids, or for any other suitable purpose using a material that acts to condition, modify, or otherwise charge the atmosphere or the environment.

A useful term to quantify the degree of volatility of the volatile materials is by their Kovat's Index. The Kovat's Index (KI, or Retention Index) is defined by the selective retention of solutes or perfume raw materials (PRMs) onto the chromatographic columns. It is primarily determined by the column stationary phase and the properties of solutes or PRMs. For a given column system, a PRM's polarity, molecular weight, vapor pressure, boiling point and the stationary phase property determine the extent of retention. To systematically express the retention of analyte on a given GC column, a measure called Kovat's Index is defined. Kovat's Index places the volatility attributes of an analyte (or PRM) on a column in relation to the volatility characteristics of n-alkane series on that column. Typical columns used are DB-5 and DB-1.

By this definition the KI of a normal alkane is set to 100n, where n=number of C atoms of the n-alkane.

With this definition, the Kovat's index of a PRM, x, eluting at time t', between two n-alkanes with number of carbon atoms n and N having corrected retention times t'n and t'N respectively will then be calculated as:

$$KI = 100 \times \left(n + \frac{\log t'_x - \log t'_n}{\log t'_N - \log t'_n}\right) \quad (1)$$

This equa[s]tion can be used to calculate the Kovat's index for any volatile material. Furthermore, this equa[s]tion can be used to further separate volatile components into three categories[;]: top, middle and base notes. Using the Kovat's index, we can define a top note as having a KI less than or equal to 1200, a middle note between 1200 and 1400 and a base note greater than or equal to 1400.

General

The delivery system 1 or apparatus consists of an electromechanical transducer 2, which is an element that is made of a material which is capable of converting electrical energy to mechanical energy. One known example of an electromechanical transducer 2 are piezoelectric materials, which have the ability to change shape when subject to an externally applied voltage that cause them to vibrate at certain frequencies. The electromechanical transducer 2 is constructed from a piezoelectric ceramic material and they can be made of several shape and forms. In the case [of] of a disc-shaped or annular electromechanical transducer 2 having separate electrodes on the inner and outer walls and being poled radially, the electrodes may excite length modes of the disc or a mode of the perforated structure 3. For example, in operation the device may be driven at a frequency that corresponds to a resonance of either the nozzle plate, the piezoelectric ceramic, or the composite structure. In this way, large displacements and accelerations of the perforated membrane 3 may be generated by applying a relatively small voltage.

Sense and Drive Electrodes

In order to maximize the electromechanical coupling to the desired mode it may be useful to shape the drive electrodes appropriately.

In order to improve the efficency of the operation it may also be useful to incorporate a sense electrode into the design. This sense electrode can give phase and amplitude information that allows an appropriate electronic circuit to lock on to the correct resonant mode. Again it may be advantageous to shape the sense electrode so as to achieve appropriate electromechanical coupling.

The electrodes may be patterned so as to incorporate "drive" and "sense" electrodes. The drive and sense electrodes are electrically insulated but mechanically coupled through the piezo itself. The drive voltage is applied to the drive electrode and the resulting motion generates a voltage at the sense electrode. This voltage can then be monitored and used to control the drive through an analogue or digital feedback circuit. The induced voltage will have an amplitude and phase in relation to the drive signal. This electrical response may be used to lock onto specified resonances either by phase locking or by amplitude maximizing or by some other means. Thus the device may be maintained in the length resonance irrespective of inter-device variations or of fluid loading.

Perforated Structure and Tapered Orifices

The perforated structure 3 may be formed from a variety of materials including electro formed nickel, etched silicon, stainless steel or plastics. It may be flexible or stiff. A flexible design is one where the amplitudes of the vibrational modes of the perforated structure are large compared with those of the electromechanical transducer 2 and this motion may have a significant effect on the droplet generation process. A stiff design is one where the amplitudes of the vibrational modes of the perforated structure are closely equal to or smaller than those of the electromechanical transducer 2 and in which this motion, generally, follows the motion of the electromechanical transducer 2. The flexibility may be controlled by a choice of material and thickness. The benefit of this design is that, unlike a device which depends on a bending mode, a stiff perforated structure will give uniform droplet ejection across its surface without causing a dampening of the overall motion.

If a flexible membrane is used, the spray pattern may be controlled by the choice of the drive frequency. For example, in the case of a flexible membrane attached to a hollow tube transducer, inducing only perturbations in its motion we can obtain ejection primarily from the membrane center by driving the piezo close to a plate resonance of the membrane. Alternatively, we can obtain ejection primarily from the region close to the membrane circumference by driving the piezo at a length resonance of the electromechanical transducer 2.

The perforated membrane 3 is bonded using an adhesive, for example Permabond E34 epoxy, to one and of the electromechanical transducer 2 and it may be formed from a variety of materials including electroformed nickel and steel. However, any suitable bonding means may be used to fix the perforated membrane 3 to the electromechanical transducer 2 element. However, in cases where the device 1 may be used to atomize liquids which are considered aggressive or corrosive in that they tend to soften certain bonding or glueing materials, it is preferred that the perforated membrane be soldered to the piezoelectric element. The perforated membrane 3 includes orifices 4 set out on a hexagonal lattice. The droplet size may be determined by varying the exit of the orifices diameter, typically between 1 and 100 microns. More preferably, the diameter of the orifices 4 is less than about 30 microns. In another embodiment, the diameter of the orifices 4 is less than about 15, preferably between 2 to 10 microns. The perforated membrane 3 is usually mounted so that the fluid mass to be dispensed as droplets lies against the side of the structure with the larger orifices.

Preferably, the orifices 4 on the perforated membrane each have a relatively smaller cross-sectional area at the front face and a relatively larger cross-sectional area at the rear face. Hereinafter, such orifices 4 are referred to as tapered orifices. Preferably, the reduction in cross-sectional area of the tapered orifices from rear face to front face is smooth and monotonic.

Such tapered orifices are believed to enhance the dispensation of volatile material. In response to the displacement of the relatively large cross-sectional area of each orifice at the rear face of the perforated membrane 3 a relatively large fluid volume is swept in this region of fluid.

Other conditions being fixed, such tapered perforations reduce the amplitude of vibration of the perforated membrane 3 needed to produce droplets of a given size. One reason for such reduction of amplitude being achieved is the reduction of viscous drag upon the liquid as it passes through the perforations. Consequently, a lower excitation of the electromechanic transducer 2 may be used. This gives the benefit of improved power efficiency in droplet creation.

Such a benefit is of high importance in battery-powered atomizer apparatus. Further, it reduces the mechanical stresses in the membrane needed for droplet production assisting in reduction of failure rate. Yet further, it enables the use of relatively thick and robust membranes from which satisfactory droplet production can be achieved. Additionally, it enables the successful creation of droplets from liquids of relatively high viscosity with high efficiency.

The tapered perforation may take several geometrical forms, including the form of the frustum of a cone, an exponential cone, and a bi-linear conical taper.

The size of the smaller cross-sectional area of the perforations on the front face of the membrane may be chosen in accordance with the diameter of the droplets desired to be emergent from the membrane. Dependent upon fluid properties and the excitation operating conditions of the membrane 3, for a circular cross-sectional perforation the diameter of the emergent droplet is typically in the range of 1 to 3 times the diameter of the perforation on the droplet-emergent face of the membrane 3.

Other factors being fixed, such as the exact geometrical form of the perforations, the degree of taper influences the amplitude of vibration of the membrane 3 needed for satisfactory droplet production from that perforation. Substantial reductions in the required membrane vibrational amplitude are found when the mean semi-angle of the taper is in the range 30 degrees to 70 degrees, although improvements can be obtained outside this range.

In operation, the fluid is delivered to a perforated membrane by some kind of fluid supply component 5 working by a process of gravity feed or capillary action or pumping action. The electromechanical transducer 2 may be driven with an oscillating voltage at one of the resonant frequencies of the system or alternatively with a waveform that gives drop-on demand operation. The perforated structure 3 is accordingly moved up and down. It is believed that a resultant pressure is induced in the fluid directly behind the perforated structure 3 and that this forces fluid through the orifices 4 to form droplets. As the droplets are dispersed the fluid moves up the tube, so allowing continuous controlled operation until the tube is exhausted of fluid.

Fluid Supply Component

In many applications, continuous fluid feed will be desired. This may be accomplished by a fluid supply component 5, which in the most simple of the embodiments may consist of a simple feed tube that delivers the fluid to the rear face of the membrane 3.

In one embodiment of this application, the perforated membrane 3 will be referred has having two faces. The front face of the membrane 3 is defined as the face from which fluid droplets (and/or short fluid jets that subsequently break up into droplets) emerge and the rear face of the membrane 3 is defined as the face opposite to the front face. The term droplets is intended to include short fluid jets emergent from the front face of perforated forms of membrane 3 that subsequently break up into droplets.

In an embodiment of this application, fluid may be supplied to the rear face of the membrane 3 in many different ways.

For example, liquid may be fed to the face of the membrane 3 by a capillary feed which may be of any material form extending from a fluid source into close proximity with the membrane 3. The capillary has a surface or assembly of surfaces over which liquid can pass from the source towards the membrane 3. Example material forms include open cell foams, fibrous wicks, porous plastic wicks, and glass or polymeric capillary tubes.

Preferably, such a capillary feed is formed from a flexible material. One example includes a thin leaf spring material placed in near contact with a face of a perforated membrane and a non-perforate continuation of that face extending to the fluid source so to draw liquid by capillary action from the source to the membrane. These flexible forms enable simple arrangements whereby the capillary feed means may be brought into light proximate contact with the membrane 3 so to deliver fluid to that membrane 3 without providing such resistance to the vibratory motion of said membrane 3 that droplet production is prevented.

In applications where relatively high droplet production rates are required, the capillary feed is preferably a relatively open structure so that the ratio of area occupied by capillary material to that area between capillary material surfaces through which fluid may flow is relatively small. Open cell flexible foams, some types of fibrous wick and open silicone coated ended glass or polymeric capillary tubes offer both the flexibility and the relatively open structure described above.

Refill Delivery Applications

In refill delivery systems applications, it may be desirable to separate the unit into two parts. The first, disposable part, may for example consist of the fluid and its container or fluid reservoir 6. The second part, which is reusable, may correspondingly consist of the electromechanical transducer 2, the perforated membrane 3 with its drive electronics and power source. Another embodiment of the invention could include a disposable part that consists of the fluid and its container and the electromechanical transducer 2, and the perforated membrane 3. The second part, which is reusable, may correspondingly consist of the drive electronics and power source.

Another embodiment of the invention consists of a collapsible bag component. In this embodiment, the fluid container is a collapsible bag. As the fluid is dispensed, the bag collapses to give almost complete emptying of the container.

Electromechanical Transducer

The drive unit preferably comprises a housing, containing a source of energy and an electronic drive, and a electromechanical transducer. A bulkhead wall separates the fluid-containing part of the disposable portion from the drive unit interior. Electrical connections pass through the bulkhead from the drive electronics to the electromechanical transducer 2.

In one of the embodiment of the invention, the electromechanical transducer 2 is constructed from a piezoelectric hollow tube. The tube has separate electrodes on the inner and outer walls and is poled radially. The electrodes again may excite length modes of the tube or a mode of the perforated structure 3, i.e. in operation the device may be driven at a frequency that corresponds to a resonance of either; the nozzle plate, the piezoelectric ceramic, or the composite structure. This transducer 3 is expandable or contractible in the direction of its central axis.

Another embodiment has a radial structure where the electromechanical transducer 2 now consists of two discs and the perforated structure 3 is attached at the edges of the electromechanical transducer 2. Fluid is fed to inner surface of the perforated structure 3 via a central hole drilled in one of the electromechanical transducers 2. Again droplets are generated by exciting the electromechanical transducer 2 and driving the perforated structure 3 radially.

In one embodiment of the invention, the electromechanical transducer 2 is formed from a piezoelectric disc-shaped or annular with thickness much smaller than its diameter. It is metallized on the two planar surfaces to provide electrodes. The perforated structure 3 takes an annular form that is affixed about its central plane to the electromechanical transducer's 2 perimeter. In operation fluid is fed via the fluid feed component 5 to the perforated membrane 3 which is excited radially by driving the electromechanical transducer 2.

Forms of the electromechanical transducer 2 may include a plate, a rectangular cross-sectioned rod and a hollow tube with length greater than the separation between its inner and outer radii. In the case of the hollow tube, the electrodes are situated on the inner and outer walls and the device is poled radially. In the case of a rectangular cross-sectioned rod, the electrodes are situated on the two closest faces. This arrangement allows for the identification and operation at the system natural resonance frequencies, which is a more efficient mode than the typically used frequency sweeps. The benefit of this feature is that a given linear displacement of the electromechanical transducer may be achieved by a smaller applied voltage. Another benefit is that the system can be operated with significantly simpler control strategy. Conveniently, the device may be run continuously at a frequency at which the displacements in the larger dimension of the electromechanical transducer 2 are in mechanical resonance. This may be at frequencies such that the resonance may be thought of as acoustic or ultrasonic resonance modes of the device. Where the perforated structure induces only a perturbation to the electromechanical characteristics of the electromechanical transducer (or in the complementary case where the electromechanical transducer induces only perturbations to the mechanical characteristics of the perforated membrane) the device may be run close to one of the piezo resonances or close to one of the perforated structure 3 resonances. The ability to run at descriptive frequencies also is beneficial to reduce system fatigue, which in turn improves durability of the piezoelectric surface. Alternatively, the device 1 may be run in a single pulse or drop on demand mode. The capability to be operated at the piezo resonances is what allows the system to be driven and controlled by significantly simpler and less expensive electronics.

In a typical device 1 the piezoelectric element is made from piezoelectric ceramic from Morgan Unilator of the UK (PC 5) or any other material having piezoelectric properties, which cause it to change dimensionally in a direction, perpendicular to the direction of an applied electric field. Wherein the electromechanical transducer 2 element expands and contracts in a radial direction when an alternating electrical field is applied on poled electrodes.

The device 1 may be driven at a number of resonant modes of the composite structure. In the example given above the mode coupling is small and these modes may be considered to be those of the piezo or those of the nozzle plate independently.

Air Disturbance Generator

An air disturbance generator 7 is used to increase fluid droplet instability in such a way as to accelerate the transition of droplets to finer droplets and eventually, to the molecular level or gas phase state of the volatile materials. This increases the ability of the volatile materials to remain airborne. The level of air disturbance is characterized by the amount of air flow volume flowing around the droplet. It is measured in units of cubic feet per minute, CFM. In one embodiment, when the air flow volume is in the range of between about 2.0 to about 8.0 CFM an increased droplet disintegration is achieved that results in higher detection of the less volatile component, resulting in higher volatile material concentration and improved hedonics and room fill or improved diffusion. The air disturbance generator 7 can be selected from the group consisting of: fan, air pump, a secondary electromechanical transducer or a combination thereof.

Operation of the Device

Fluid is supplied to one side of the perforated structure 3 either in the form of a drop or by some continuous feed mechanism. Suitable feed mechanisms are disclosed in U.S. Pat. No. 5,518,179. During the intended usage of the device 1 the fluid may be exposed to various pressure conditions, i.e., the fluid may be at ambient pressure, slightly below ambient pressure or slightly above ambient pressure. The electromechanical transducer 2 is then driven using the drive electronics. The drive may be in the form of continuous sine waves, other continuous waves, single pulses, trains of pulses, single synthesized waveforms, or trains of single synthesized waveforms. The linear electromechanical transducer 2 motion excites a corresponding linear motion in the perforated structure 3. This motion in the perforated structure 3 causes droplets to form and travel away from the perforated structure 3.

The device 1 may be driven, through electrodes via conductors, continuously to generate a continuous fluid droplet stream. The continuous drive signal may be in the form of continuous sine waves, square waves, or other continuous wave forms. The device 1 may also be driven with pulses to generate drops on demand. The pulse may consist of a half cycle, a full cycle, a train of half cycles or full cycles, a synthesized waveform or a train of synthesized waveforms. When driven with pulses, we may choose the pulse cycle period to correspond to a natural frequency of oscillation of the composite transducer.

The nozzle plate may have a single orifice or a pattern of orifices, laid out, for example, in a line, circle or other pattern. The plate may be designed so that all of the nozzles eject a drop upon actuation or so that different nozzles eject a drop according to the drive signal. For example, at some operating frequencies and with a linear nozzle pattern on a suitable nozzle plate, the central nozzle will generate a drop when the electromechanical transducer is driven by a relatively weak drive signal. As the drive signal is increased the adjacent nozzles become active and thus a higher scent intensity profile is generated.

In a preferred embodiment, the scent delivery head incorporates a piezoelectric disc of lead zirconate titanate ceramic and a nozzle plate made of nickel.

In operation, the piezoceramic may be driven continuously at its resonant frequency, which may be on the order of 75 kHz, to deliver a continuous stream of droplets. It may also be driven in a drop-on-demand mode (DOD). When driven in DOD mode the piezo must be driven to achieve an amplitude and acceleration at the nozzle plate that achieves single drop generation. This may be done in a number of ways. For example the piezo may be driven with a single square pulse of appropriate height and width. Alternatively, the piezo may be pumped up to an appropriate amplitude by driving with a number of cycles or half-cycles of lower amplitude, for example two full square wave cycles with half the height and double the width. By placing an inductor with an appropriate inductance in series with the piezoelectric ceramic, the drive voltage may be reduced still further. For example, by placing a 700 μH inductor in series with the piezo, in the same embodiment we can reduce the drive voltage whilst maintaining the square wave form with same width period, again driving over two full cycles. The advantage of this second approach is that lower voltages are applied to the device and this significantly simplifies the design and reduces the cost of both the drop generator and the electronics. It is possible to vary the drop size by an appropriate variation of the drive conditions, for example by varying the signal amplitude over a factor of two.

Liquid Reservoir

A liquid reservoir 6, which contains a liquid to be atomized, is mounted below the electromechanical transducer 2 and orifice plate 3. A fluid supply component 5 extends up from within the reservoir to rear face of the orifice plate so that it lightly touches the orifice plate in the center region and so that it contacts the perforations. However, the fluid supply component 5 should not touch the holes and these orifices should be laterally displaced from the fluid supply component.

This system can be operated by directly plugging into the wall outlet or from an internal power source.

EXAMPLES

Example 1 compares a piezoelectric delivery system with a piezoelectric delivery system assisted by an air disturbance generator according to the following method, in situ monitoring of perfume components by GC/MS.

In this method, the testing device is placed in a 100 $ft^3$ room with standard room circulation. The samples are collected at 0.2, 3, 6, and 9 feet. For each time point a sample is taken at each position. An initial background room sample is taken. The device is placed in the room and turned on. After that, samples are collected at initial, 6, 12 and 18 minutes. The air samples are collected using 4 Gil Air Personal Air Sampler pumps collecting samples for 3 minutes at 1 L/minute. Samples are collected on 50 mg Tenax TA traps and desorbed using an MPS-2 TDU into a GC/MS system. Samples are analyzed using a 6890/5973 GC/MS with a DB-1 column (1 μm film thickness, 0.32 mm ID, 60 m length). The data is reported with respect to the number of detectable components as well as Flame Ionization Detector response (FID).

Table 1 shows a higher number of detectable components at all measurement distances from the device at the 18 minute sample when the piezoelectric delivery system is assisted by an air disturbance generator. Surprisingly, the air disturbance generator produced significantly more detectable components even in the area directly beside the device. As defined in the following example, the use of an air disturbance generator also had a dramatic effect on the hedonic character of the perfume. Similar trends are observed at the other time measurements.

TABLE 1

| | Number of Detectable Components Given Distance from the Device | | | |
|---|---|---|---|---|
| | 0.2 feet | 3 feet | 6 feet | 9 feet |
| Piezoelectric Only | 7 | 7 | 6 | 7 |
| Piezoelectic with air disturbance generator | 22 | 17 | 14 | 12 |

Example 2 compares a piezoelectric delivery system with a piezoelectric delivery system assisted by an air disturbance generator according to the following Sensory Evaluation Method for delivery systems or apparatus.

This method for sensory evaluations of delivery systems or apparatus is conducted according to the guidelines listed herein. A dedicated odor evaluation room is utilized for all sensory evaluations. A trained odor evaluator verifies that there is not any residual perfume or room odor present in the room. The door(s) to the room are closed and the delivery system or apparatus is activated by a test facilitator. Trained odor evaluators enter the odor evaluation room and perform odor evaluations at the following time intervals: (1) 3 minutes after activation (2) 6 minutes after activation (3) 12 minutes after activation and (4) 18 minutes after activation. In addition to the above listed time intervals, the sensory evaluations are conducted at the following distances from the delivery system or apparatus starting at the furthest distance: (1) 3 feet (2) 6 feet and (3) 9 feet. Expert evaluators exit the room between odor evaluations and the door(s) are closed between odor evaluations. Expert evaluators provide odor intensity measurements on a sensory rating scale of 0-5.

Perfume Intensity Scale:

5=very strong, i.e., extremely overpowering, permeates into nose, can almost taste it 4=strong, i.e., very room filling, but slightly overpowering 3=moderate, i.e., room filling, odor character clearly recognizable 2=light, i.e., fills part of the room, with recognizable odor character 1=weak, i.e., diffusion is limited, odor character difficult to describe, 0=no scent Table 2 illustrates the improved perfume hedonic data at all distances from the device when the piezoelectric delivery system is assisted by an air disturbance generator. This translates to the consumer as better perfume intensity and character.

TABLE 2

| | Perfume intensity grade at given distance from the device | | |
|---|---|---|---|
| | 3 feet | 6 feet | 9 feet |
| Piezoelectric Only | 1.0 | 0.5 | 0.0 |
| Piezoelectic with air disturbance generator | 2.5 | 2.5 | 2.0 |

Example 3 compares the effect that the volume of air has on the hedonic perception of the perfume formula according to the same method as defined in example 2, sensory evaluations of delivery systems or apparatus.

Air flow measurements are made according to ASHRAE Standard 51 or AMCA Standard 210 (Laboratory Methods of Testing Fans for Aerodynamic Performance Rating). The air flow volume flow rate measurement are made using units of cubic feet per minute, CFM. CFM measurements are calculated and the result indicates the volume of air that passes through the dispensing system.

TABLE 3

| | Perfume intensity grade at given distance from the device | | |
|---|---|---|---|
| | 3 feet | 6 feet | 9 feet |
| 0.0 CFM* | 1.0 | 0.5 | 0.0 |
| 1.0 CFM | 1.5 | 1.0 | 0.0 |
| 2.0 CFM | 2.5 | 2.0 | 1.0 |
| 3.0 CFM | 2.5 | 2.0 | 1.5 |
| 4.0 CFM | 2.5 | 2.5 | 2.0 |

*Piezolectric only application

The data indicates that to have a light to moderate intensity grade (according to the previously defined scale) with recognizable character at 3 to 6 feet from the device and the recognition of scent at the 9 foot distance, an air disturbance of 2.0 CFM is needed. A piezolectric only system delivers no discernable benefit at the 9 foot distance.

Table 4 lists the composition of the volatile material formulation. The data shows the increase in number of detectable components, 22 versus 7, as well as the increase in gas phase volatile material concentration for the disturbance generator assisted device (with fan).

TABLE 4

| Component/Perfume Raw Materials | Electromechanical Transducer | Electromechanical Transducer + Fan |
|---|---|---|
| Octamethyl-Cyclotetrasiloxane (KI 874) | 2.91E+08 | 7.85E+08 |
| d-Limonene (KI 1040) | 1.40E+06 | 5.03E+06 |
| diHydro Myrcenol (KI 1074) | 4.99E+05 | 1.74E+06 |
| Decamethyl-Tetrasiloxane (KI 1053) | 8.60E+05 | 3.04E+06 |
| TetraHydro Linalool (KI 1102) Linalool (KI 1104) | 4.74E+05 (2)* | 1.35E+06 (2)* |
| Benzyl Acetate (KI 1173) | 4.89E+05 | 1.56E+06 |
| iso-Nonyl Acetate (KI 1179) | ND | 1.47E+06 |
| Methyl Phenyl Carbinyl Acetate (KI 1201) | ND | 1.78E+07 |
| Methyl Ester 3-Nonenoic acid (KI 1220), Phenyl Acetaldehyde DiMethyl Acetal (KI 1228), Dodecamethyl-Pentasiloxane (KI 1219) | ND | 2.88E+05 (3)* |
| Beauverate (KI 1272), Ethyl Safranate Isomers (KI 1245) | ND | 2.07E+07 (2)* |
| iso-Bornyl Acetate (KI 1304) | ND | 1.16E+06 |
| Verdox Major (KI 1309) | ND | 9.39E+05 |
| DiMethyl Octanyl Acetate (KI 1319) | ND | 1.13E+06 |
| Veloutone (KI 1324) | ND | 1.48E+06 |
| Verdox Minor (KI 1318) | ND | 7.24E+05 |
| Flor Acetate Major (KI 1441) | ND | 6.96E+05 |
| DiHydro Cyclacet (KI 1467) | ND | 4.85E+07 |
| Felvinone (Epitone) Major (KI 1485) | ND | 1.47E+06 |
| Detectable Components | 7 | 22 |

*Number of simultaneously detected components.

The data also show a correlation between the detectable components and their Kovat's index. Only the highly volatile components of the formulation, also referred to as top notes, or those who have a Kovat's index below 1200, are detected on the "no fan" device.

Without being bound to any theory, a hypothesis can be drawn where after the droplet is generated and emitted to the environment, only the very volatile components or top notes are able to volatilize away from the droplet and remain airborne. The other less volatile components are not able to volatilize or transition into the gas phase or molecular level therefore fall to the surrounding surfaces, limiting their probability of being detected by this analytical method or perceived by the user.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

While particular embodiments of the subject invention have been described, it will be obvious to those skilled in the art that various changes and modifications of the subject invention can be made without departing from the spirit and scope of the invention. In addition, while the present invention has been described in connection with certain specific embodiments thereof, it is to be understood that this is by way of illustration and not by way of limitation and the scope of the invention is defined by the appended claims which should be construed as broadly as the prior art will permit.

What is claimed is:

1. A device for generating droplets of fluid, the device comprising:

a) a fluid reservoir comprising a perfume raw material, said perfume raw material having a Kovat's Index of less than 1200;

b) a wick extending from said fluid reservoir, said wick and said fluid reservoir form a replaceable sub-assembly;

c) a disc-shaped piezoelectric element;

d) a droplet generation element, said droplet generation element comprises a perforate plate having two or more tapered orifices, said perforate plate coupled for movement with said disc-shaped piezoelectric element and positioned for contact with said fluid; and e) a fan capable of creating an air disturbance of about 1.0 CFM.

2. A device according to claim 1, wherein the fluid supply component supplies fluid via a process selected from the group consisting of gravity feed, wicking, capillary action, pumping action and combinations thereof.

3. A device according to claim 1, wherein the piezoelectric element is tubular.

4. A device according to claim 1, wherein the piezoelectric element has electrodes disposed across those two surfaces which give the shortest inter-electrode distance, and further, wherein the transducer has a length which is much greater than that interelectrode distance, so that it is the length extension of the electromechanical transducer that is used to excite the droplet generation element.

5. A device according to claim 1, wherein said device permits refilling of the fluid.

6. A device according to claim 1, wherein said device is capable of operating from an internal power source.

7. A device according to claim 1, wherein said device is capable of being plugged directly into a wall outlet.

8. A device according to claim 1, having multiple electromechanical transducers.

9. A method for delivering scent comprising utilizing the droplet generating device of claim 1.

10. A device for generating droplets of fluid, the device comprising:

a) one or more fluid supply components, said fluid supply component linked to one or more fluid reservoirs;

b) multiple fluid reservoirs each comprising a perfume raw material, said perfume raw material having a Kovat's Index of less than 1200;

c) multiple electromechanical transducers;

d) multiple droplet generation elements, coupled for movement with one or more of the electromechanical transducers and positioned for contact with said fluid; and e) a fan is capable of creating an air disturbance of about 1.0 CFM, wherein said droplet generation element has one or more tapered orifices and said multiple fluid reservoirs contain scent emitting volatile materials.

11. A device for generating droplets of perfume raw materials, the device comprising:

a) a reservoir comprising a perfume raw material, said perfume raw material having a Kovat's Index of greater than or equal to 1200;

b) a wick extending from said reservoir, said wick and said reservoir form a replaceable sub-assembly;

b) a piezoelectric element;

c) a droplet generation element, said droplet generation element comprises a perforate plate having two or more orifices, said perforate plate coupled for movement with said piezoelectric element and positioned for contact with said perfume raw materials; and d) a fan capable of creating an air disturbance between about 2.0 to about 4.0 CFM.

* * * * *

UNITED STATES PATENT AND TRADEMARK OFFICE

CERTIFICATE OF CORRECTION

PATENT NO. : 7,490,815 B2
APPLICATION NO. : 11/273461
DATED : February 17, 2009
INVENTOR(S) : Fernando Ray Tolléns et al.

It is certified that error appears in the above-identified patent and that said Letters Patent is hereby corrected as shown below:

The title page, showing an illustrative figure, should be deleted and substitute therefor the attached title page.

Delete the Drawing sheet and substitute therefor the Drawing sheet consisting of figure 1 as shown on the attached page.

Column 1

Line 15, after "generator", insert -- . --.

Column 5

Line 56, delete "equa[s]tion" and insert -- equation --.

Line 57, delete "equa[s]tion" and insert -- equation --.

Lines 58-59, delete "catagories[;]:" and insert -- catagories: --.

Column 6

Line 8, delete "[of]".

Column 7

Line 8, delete "and" and insert -- end --.

Claim 4

Line 5, delete "interelectrode" and insert -- inter-electrode --.

Signed and Sealed this

Third Day of November, 2009

David J. Kappos

David J. Kappos
*Director of the United States Patent and Trademark Office*

(12) United States Patent
Tolléns et al.

(10) Patent No.: US 7,490,815 B2
(45) Date of Patent: Feb. 17, 2009

(54) DELIVERY SYSTEM FOR DISPENSING VOLATILE MATERIALS USING AN ELECTROMECHANICAL TRANSDUCER IN COMBINATION WITH AN AIR DISTURBANCE GENERATOR

(75) Inventors: Fernando Ray Tolléns, Cincinnati, OH (US); Christopher Robert Kopulos, West Chester, OH (US); Jonathan Robert Cetti, Mason, OH (US); Steven James Schroeck, Cincinnati, OH (US); Steven Louis Diersing, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 385 days.

(21) Appl. No.: 11/273,461

(22) Filed: Nov. 14, 2005

(65) Prior Publication Data

US 2007/0108310 A1 May 17, 2007

(51) Int. Cl.
*B01F 3/04* (2006.01)

(52) U.S. Cl. ..... 261/30; 261/81; 261/DIG. 48; 261/DIG. 88

(58) Field of Classification Search ..... 261/28, 261/30, 37, 81, DIG. 48, DIG. 88
See application file for complete search history.

(56) References Cited

U.S. PATENT DOCUMENTS

| | | | | |
|---|---|---|---|---|
| 3,543,122 | A | 11/1970 | Klebanoff et al. | |
| 3,615,041 | A | 10/1971 | Bischoff | |
| 4,479,609 | A | 10/1984 | Maeda | |
| 4,533,082 | A | 8/1985 | Maehara et al. | |
| 4,731,204 | A * | 3/1988 | Noma et al. | 261/30 |
| 4,790,479 | A | 12/1988 | Matsumoto | |
| 5,152,456 | A * | 10/1992 | Ross et al. | 239/102.2 |
| 5,297,734 | A | 3/1994 | Toda | |
| 5,485,828 | A * | 1/1996 | Hauser | 128/200.16 |
| 5,518,179 | A | 5/1996 | Humberstone et al. | |
| 5,624,608 | A * | 4/1997 | Ching et al. | 261/30 |
| 5,836,515 | A * | 11/1998 | Fonzes et al. | 239/102.2 |
| 6,039,309 | A * | 3/2000 | Kuklinski | 261/1 |
| 6,062,212 | A * | 5/2000 | Davison et al. | 128/200.16 |
| 6,102,992 | A * | 8/2000 | Berg et al. | 96/361 |
| 6,341,732 | B1 | 1/2002 | Martin et al. | |

(Continued)

FOREIGN PATENT DOCUMENTS

WO WO 03/068413 A1 8/2003

(Continued)

OTHER PUBLICATIONS

International Search Report received in connection with PCT/IB2006/054243, mailed on Apr. 5, 2007, 4 pages.

*Primary Examiner*– Scott Bushey
(74) *Attorney, Agent, or Firm*– Amy L. Ahn-Roll

(57) ABSTRACT

Disclosed herein is a delivery system or apparatus for the production, evaporation or release and wide dispersion of volatile materials using an electromechanical transducer or electromechanical transducer, wherein the transition from droplets to the molecular level of the volatile material is assisted by an air disturbance generator. By increasing the rate of droplet disintegration and the emission or release of the volatile materials, higher detection of the less volatile components is achieved, resulting in higher volatile material concentration and improved hedonics, thus delivering an improved method of dispensing such volatile materials. The system is highly energy efficient and capable of battery operation.

11 Claims, 1 Drawing Sheet

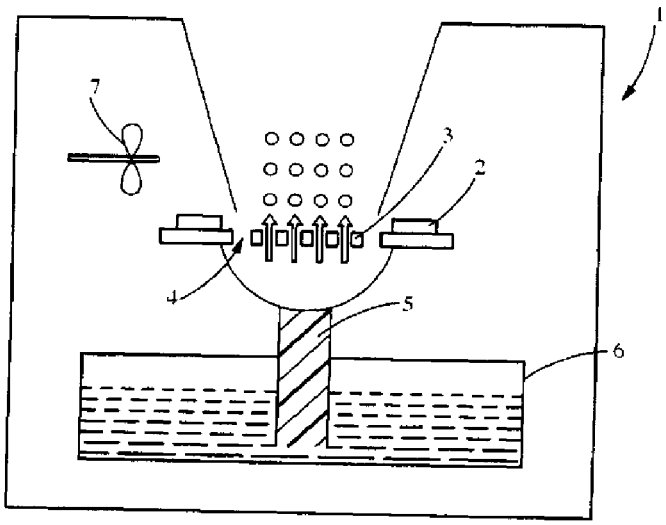

U.S. Patent Feb. 17, 2009 7,490,815 B2